United States Patent [19]

Kisner

[11] Patent Number: 5,062,607

[45] Date of Patent: Nov. 5, 1991

[54] HOLDER FOR DETACHABLY MOUNTING A RECEPTABLE ON A LADDER

[76] Inventor: Howard A. Kisner, River Rd. PO 177-0177, Volga, W. Va. 26238

[21] Appl. No.: 640,831

[22] Filed: Jan. 14, 1991

[51] Int. Cl.[5] ..... E06C 7/14

[52] U.S. Cl. ..... 248/211

[58] Field of Search ..... 248/211, 210, 315

[56] References Cited

U.S. PATENT DOCUMENTS

| | | | |
|---|---|---|---|
| 2,686,032 | 8/1954 | Thorson | 248/211 |
| 3,108,776 | 10/1963 | Cook | 248/210 |
| 3,462,109 | 8/1969 | Forbes | 248/210 |
| 3,738,601 | 6/1973 | Gehringer | 248/210 |
| 4,433,822 | 2/1984 | Caggiano | 248/210 |

OTHER PUBLICATIONS

Advertisement from "Brookstone Catalogue", Fall 1989.

*Primary Examiner*—Ramon O. Ramirez
*Assistant Examiner*—Robert A. Olson

[57] ABSTRACT

A holder for detachably mounting a receptacle, such as a paint can, to a ladder has a generally L-shaped body having a foot portion and a back portion. The back portion is connected to a U-shaped curved portion and extension portion which form a hook for attaching the holder to a first rung of the ladder. The foot portion is connected to a front portion and rests on a second rung beneath the first rung of the ladder. A pivotable restraint member is attached to the back portion. This restraint member encloses the receptacle when it is resting on the foot portion in order to hold the receptacle on the holder. This holder can easily and quickly be mounted to the ladder. A top opening in the receptacle is easily accessed when using the holder. The restraint member is pivotable so that the holder can fold flat for transport and storage.

14 Claims, 2 Drawing Sheets

HOLDER FOR DETACHABLY MOUNTING A RECEPTABLE ON A LADDER

BACKGROUND OF THE INVENTION

1. Field of the Invention

The present invention relates to a holder for detachably mounting a receptacle, such as a paint can, on a ladder.

2. Description of the Background Art

Various holders are known in the art for mounting a receptacle to a ladder. More specifically, various holders are known for affixing a paint can to a ladder. One of these holders involves attaching a wire to the handle of the paint can. This wire is then draped over a rung of the ladder. Unfortunately, the paint can is not held steady in this arrangement. Moreover, the opening to the paint can is obstructed by the handle and wire. Additionally, the paint can may hang beneath the ladder such that it is difficult for the user to get to the can.

A second type of holder is known wherein bars jutting from the side of the holder are inserted into openings in the side of the ladder. However, many ladders do not have these openings and so these holders are unacceptable for use with many ladders. Moreover, if the ladder is tilted to a certain angle and if the receptacle is generally full, the contents of the receptacle will spill therefrom. In other words, the angle of the holder is fixed relative to the ladder. Therefore, if the ladder is at too great of a slant, the can will be tilted such that paint will spill therefrom.

Accordingly, a need in the art exists for an easy to use receptacle holder which is satisfactory for use with many types of ladders. Such a holder should provide unobstructed access to the opening of the receptacle and be readily usable by both right and left-handed persons. This holder should be sturdy and hold the receptacle stably but have some degree of flexibility such that it can be adjusted for different pitches of the ladder.

SUMMARY OF THE INVENTION

Accordingly, it is a primary object of the present invention to provide a holder for detachably mounting a receptacle on a ladder which is sturdy and will stably hold the receptacle in position.

It is another object of the present invention to provide a holder which is easy to use and inexpensive to manufacture.

It is a further object of the present invention to provide a holder which provides unobstructed access to an opening in the top of the receptacle.

It is still a further object of the present invention to provide a holder which permits use of either or both hands of a user such that the holder is readily usable by both right and left-handed persons.

Yet another object of the present invention is to provide a receptacle which requires no special equipment or modification to the receptacle when the receptacle is placed in the holder.

Another object of the present invention is to provide a holder which requires no special equipment or modification to the ladder for affixing the holder to the ladder.

It is still a further object of the present invention to provide a holder which can be used on ladders without holes in the sides therefor.

Another object of the present invention is to provide a holder which is easy to move relative to the ladder and can be readily adjusted along the length of the ladder.

Yet another object of the present invention is to provide a holder which can accommodate different slopes of the ladder while securely holding the receptacle and its contents.

A further object of the present invention is to provide a receptacle which can fold to a relatively flat position for compact transportation, storage and packing.

It is yet another object of the present invention to provide a holder which is highly reliable and requires little, if any, maintenance.

These and other objects of the present invention are fulfilled by providing a holder for detachably mounting a receptacle on a ladder. This holder has a generally L-shaped body having a foot portion and a back portion. The back portion is connected to an extension portion through a curved portion. This back portion, curved portion and extension portion form a hook which can attach the holder to a first rung of the ladder. The foot portion of the body member has a front portion attached thereto. At least this foot portion can rest on a second, lower rung of the ladder with the front portion assuring the holder will not slip from the second rung. Retainer means are connected to the back portion of the body member. This retainer means includes a pivotable restraint member. This restraint member will enclose the receptacle while the receptacle is resting on the foot portion of the body member. In this manner, the receptacle can assuredly be held.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
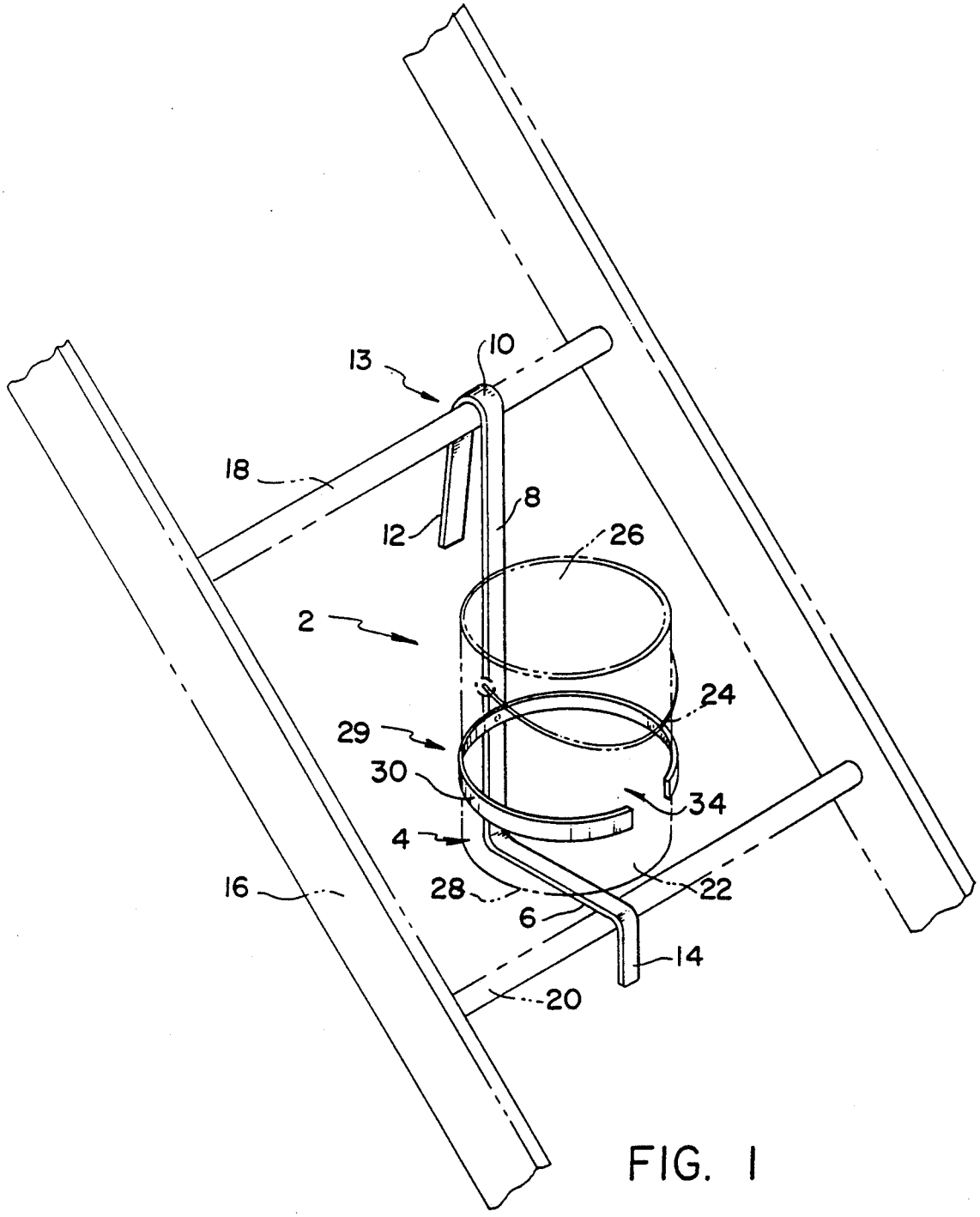
FIG. 1 is a perspective view of the holder of the instant invention mounted on a ladder.

Referring in detail to the drawings and with particular reference to FIG. 1, a holder 2 for detachably mounting a receptacle 22 on a ladder 16 is shown. This holder 2 comprises a L-shaped body member 4 having a foot portion 6 and a back portion 8. As seen in FIG. 1, the bottom 28 of receptacle 22 rests on foot portion 6. The side of the receptacle 22 runs generally along the back portion 8 with a restraint member 30 provided therebetween as will be discussed in detail below.

At the upper end of back portion 8 is a U-shaped curved portion 10. Extending downwardly from this curved portion 10 is an extension portion 12. The upper part of the back portion 8, the curved portion 10 and the extension portion 12 form a hook 13. This hook 13 can be mounted over an upper rung 18 of ladder 16.

The foot portion 6 of the body member 4 has a front portion 14 attached thereto. The front portion 14 and foot portion 6 generally have an L-shape. The front portion 14 and extension portion 12 extend downwardly, generally in the same direction.

As seen in FIG. 1, the foot portion 6 rests on the lower rung 20 of ladder 16. The front portion 14 will be positioned in front of lower rung 20. Depending on the slant of ladder 16 and the distance between upper rung 18 and lower rung 20, the back side of front portion 14 may or may not engage the face of lower rung 20. This front portion 14 will nonetheless ensure that the holder 2 does not slip from between the rungs 18 and 20 and will therefore ensure that this holder 2 remains in position.

While upper rung 18 and lower rung 20 have been shown as circular rungs, it should be appreciated that flat rungs or the like can be used. Moreover, while the device has been discussed as being used with a ladder, it should be appreciated that this device can be used on steps having slats or other openings therein or similar structures.

When mounting the holder 2 to ladder 16, the hook 13 is merely placed over upper rung 18. The foot portion 6 can then rest on the lower rung 20. Thus, mounting of the holder device 2 to ladder 16 is easily carried out.

As further seen in FIG. 1, the top 26 of receptacle 22 is readily accessible. Thus, when a paint can or other container having an open top is used as receptacle 22, access to the receptacle 22 is unobstructed. Moreover, the handle 24 of receptacle 22 is in a noninterfering position. This receptacle 22 does not hang beneath the ladder such that it is easy to get to. In this manner, ease in access to receptacle 22 is provided. Right and left-handed users are therefore freely able to use this holder device 2. Moreover, a person can use both hands when painting, for example.

As the need arises for changing the positioning of holder 2 relative to ladder 16, it is relatively easy to simply remove receptacle 2 from rungs 18 and 20 and place this receptacle on another pair of rungs. This movement is easily carried out and requires no special equipment. Moreover, because the holder 2 simply mounts over existing rungs of the ladder, there is no need for special equipment for mounting the holder 2 to the ladder. This holder 2 does not use holes in the side of the ladder similar to various prior art arrangements. Therefore, this holder can readily be used on ladders failing to have holes.

Figure 4:
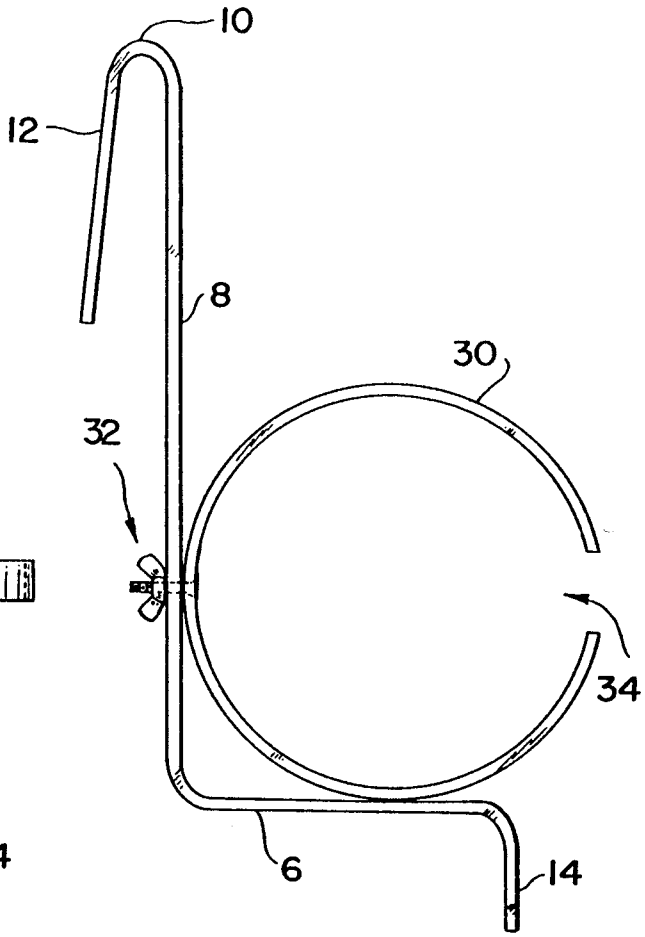
FIG. 4 is a side view similar to FIG. 3 of the holder of the instant invention with the restraint member in the storage position.
Figure 3:
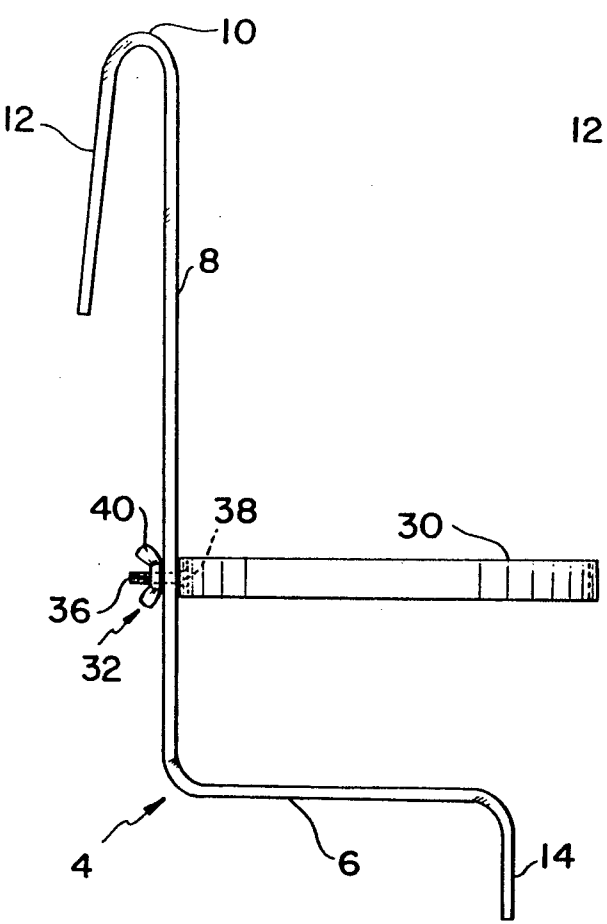
FIG. 3 is a side view of the holder of the instant invention with the restraint member in the use position.
Figure 2:
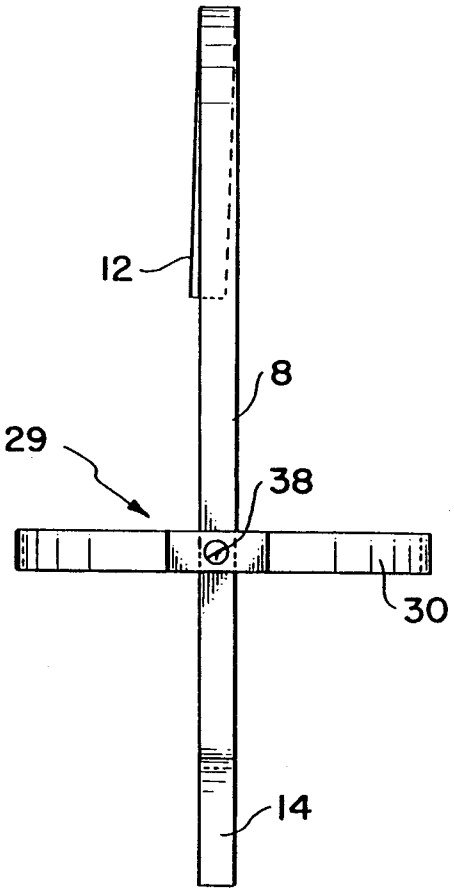
FIG. 2 is a front view of the receptacle of the present invention with the restraint member in the use position.

As seen in FIGS. 2–4, a retainer means 29 is mounted on the back portion 8 of body member 4. This retainer means 29 includes restraint member 30 and pivot means 32. The restraint member 30 has a generally circular shape with an opening 34 provided in the front portion thereof. This opening allows slight movement of the sides of the restraint member 30. In this manner, receptacles 22 having slightly varying sizes can be accommodated.

The restraint member 30 is pivotably mounted to back portion 8 by pivot member 32. This pivot member 32 includes a rod or screw 36 having a head 38. The head 38 is positioned on the inside of restraint member 30. However, this head 38 can be flush with restraint member 30 such that insertion of the receptacle 22 into restraint member 30 is unhindered.

The screw 36 further has a nut 40 attached thereto. This nut 40 can be tightened in order to rigidly hold the restraint member 30 in position.

As seen in FIG. 3, the restraint member 30 is in a use position. In this use position, the receptacle 22 can be inserted into the restraint member 30 with the bottom 28 of receptacle 22 coming into contact with foot portion 6.

However, when it is desired to store, transport or package the holder 2, the restraint member 30 can be pivoted to the position shown in FIG. 4. The radius of the generally circular restraint member 30 is less than the distance from screw 36 to the foot portion 6. In that manner, pivoting or even rotation of the restraint member 30 is unhindered. While FIG. 4 generally shows the lower portion of restraint member 30 in contact with foot portion 6, the pivot member 32 can be positioned such that the restraint member will not contact the foot portion 6. Alternatively, the pivot member 32 can be positioned closer to the foot portion 6 such that only pivoting (and not rotation) of the restraint member 30 is possible. The foot member 6 will engage the restraint member and prevent further rotation thereof.

Nonetheless, the arrangement shown in FIG. 4 wherein the restraint member is both rotatable as well as pivotable has the advantage in that the holder device 2 can be made generally flat. This is especially advantageous in packing and storing the device.

The lower portion of the restraint member 30 which is contacting the foot portion 6 in FIG. 4 would be the left-hand portion of restraint member 30 of FIG. 2 if the restraint member was pivoted counterclockwise. Alternatively, the restraint member 30 could be pivoted clockwise such that the right-hand portion of restraint member 30 would engage the foot portion 6. Great flexibility in movement of the restraint member is provided.

While a screw 36 and nut 40 have been shown as the pivot means 32, it should be understood that many other joining arrangements are possible for the retainer means 29. For example, a rod may simply join the retainer means 29 to the back portion 8. Alternatively, the retainer means 29 may be rigidly mounted to the back portion 8. However, in such an arrangement it would not be possible to pivot the retainer member to a flat position as indicated in FIG. 4. Nonetheless, this arrangement would avoid the use of screw 36 and nut 40. Also, if the retainer means 29 was rigid with the back portion 8, then the holder device 2 inclusive of the body member 4 and retainer means 29 could be molded or otherwise manufactured as a single one-piece element.

It is contemplated that the holder device 2 of the instant invention will made from metal. However, it should be appreciated that this device can also be molded from plastic or any other suitable material. Moreover, portions of this holder device 2 may be made from differing materials.

In FIG. 2, the extension portion 12 appears to not be aligned with the back portion while the front portion 14 is aligned with back portion 8. This nonaligned positioning of extension portion 12 is exaggerated merely to aid viewing of this extension portion 12. Also, as shown in FIG. 3, the extension portion 12 is angled relative to the back portion 8. It is contemplated that the U-shaped curved portion 10 can be arranged such that a longitudinal plane passing through the extension portion 12 is generally parallel to a longitudinal plane passing through the back portion 8. Alternatively, the extension portion 12 can be manufactured with an angle greater than that shown in FIG. 3. It is simply necessary to provide the extension portion 12 with a sufficient angle such that it will capture the upper rung 18 to hold the holder device 2 on the ladder 16.

In FIGS. 3 and 4, the front portion 14 is shown as being generally aligned with the back portion 8. Specifically, a longitudinal axis passing through the front portion 14 is generally parallel to a longitudinal axis running through the back portion 8. The foot portion 6 would have a longitudinal axis therethrough which is generally perpendicular to the axes of the front portion 14 and back portion 8. Nonetheless, it should be recognized that this particular configuration could be modified. For example, the angle between the front portion 14 and foot portion 6 could be modified. It is simply necessary that the front portion 14 provide a sufficient lip such that it will prevent the holder 2 from slipping from the lower rung 20.

The body member 4, curved portion 10, extension portion 12 and front portion 14 are a single, one-piece unit.

It should be apparent that the holder 2 of the instant invention is a relatively simple device. This holder is not only easy to manufacture and use but it is also inexpensive to manufacture. The holder 2 is sturdy and will stably hold the receptacle 22. If the holder 2 were to be used on ladders having different distances between rungs 18 and 20, different portions of the lower face of foot portion 6 would merely rest on the lower rung 20.

Depending on the pitch of the ladder, contents, such as paint, could spill from the receptacle 22. However, the holder 2 can be wedged between the rungs 18 and 22 such that the top 26 of receptacle 22 approaches a generally horizontal position. The upper rung 18 can be positioned between extension portion 12 and back portion 8 but in nonengagement with the U-shaped curved portion 10. The foot portion 6 can be pushed rearwardly until the front portion 14 engages the lower rung 20. In this manner, slight adjustment of the tilt of the receptacle 22 is possible. Nonetheless, the receptacle 22 will stably and securely be held in position.

In normal use, both the foot portion 6 and front portion 14 will engage the lower rung 22. However, in extreme circumstances when the distance between upper rung 18 and lower rung 20 is great, the holder 2 can continue to be used. For instance, the hook 13 can be placed over the upper rung 18. The back of front portion 14 may only engage the lower rung 20. If the distance between the upper rung 18 and lower rung 20 is increased, the receptacle 22 will continue to be held in the position shown in FIG. 1 up to the distance of a length of the front portion 14. When there is too great a distance between the upper rung 18 and lower rung 20 such that the hook 13 and front portion 14 can no longer simultaneously engage the respective rungs 18 and 20, the device can then be used by merely hanging hook 13 over the upper rung 18. The holder 2 would then hang downwardly. Depending on the slope of ladder 16, the can may hang beneath the plane of ladder 16 in this situation. Nonetheless, the holder 2 could continue to be used. However, such extreme circumstances are not contemplated as normal use for the instant holder 2.

In normal use, the holder 2 will stably hold the can in position by engaging upper and lower rungs 18, 22. This holder 2 provides for unobstructed access to an opening in the top 26 of receptacle 22. As previously discussed, this holder is readily usable by right and left-handed persons and no special equipment is needed for placing the receptacle 22 in the holder 2 or for placing the holder 2 on the ladder 16. The holder 2 can be easily adjusted along the length of ladder 16 and can fold to a position shown in FIG. 4 for compact transportation, storage and packaging. Many advantages of the instant holder 2 should therefore be apparent.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A holder for detachably mounting a receptacle on a ladder, the holder comprising:

a generally L-shaped body member, said body member having a foot portion and a back portion, the receptacle resting on the foot portion when being held by the holder;

an extension portion connected to the back portion by a curved portion, the back portion, curved portion and extension portion forming a hook to attach the holder to a first rung of the ladder with the extension portion being positioned behind the first rung when the holder is mounted on the ladder;

a front portion connected to the foot portion of the body member, said front portion being positioned in front of a second rung of the ladder and at least the foot portion engaging the second rung of the ladder when the holder is mounted on he ladder, the first rung of the ladder being above the second rung; and retainer means for holding the receptacle on he holder, the retainer means being pivotally attached to the back portion of the body member and the retainer means comprising a restraint member having a generally circular shape, the restraint member being attached to the back portion at a predetermined position, the predetermined position being spaced from the foot portion of the body member by a distance which is greater than the radius of the restraint member.

2. The holder as recited in claim 1, wherein a longitudinal axis passing through the front portion is generally parallel to a longitudinal axis passing through the back portion of the body member, and wherein a longitudinal axis passing through the foot portion is generally perpendicular to the longitudinal axes of the front portion and back portion.

3. The holder as recited in claim 1, wherein the retainer means is pivotable to a position to form a generally flat surface with at least the body member.

4. The holder as recited in claim 1, wherein the body member, extension portion, curved portion and front portion are an integral, one-piece unit.

5. The holder as recited in claim 1, wherein the body member, extension portion, curved portion and front portion are metal.

6. The holder as recited in claim 1, wherein the hook formed by the back portion, the curved portion and the extension portion generally has a U-shape and wherein the front portion and the foot portion are connected to form generally an L-shape.

7. The holder as recited in claim 6, wherein a longitudinal axis passing through the front portion is generally parallel to a longitudinal axis passing through the back portion of the body member, and wherein a longitudinal axis passing through the foot portion is generally perpendicular to the longitudinal axes of the front portion and back portion.

8. The holder as recited in claim 7, wherein the restraint member is pivotable to a position where at least the restraint member, body member and front portion form a generally flat surface.

9. The holder as recited in claim 1, wherein the retainer means further comprises a pivot member for pivotally attaching the restraint member to the back portion of the body member, the restraint member encloses the receptacle when the receptacle is placed therein.

10. The holder as recited in claim 9, wherein the pivot member comprises a rod passing through both the restraint member and the body member, said restraint member being pivotable relative to the body member about an axis passing longitudinally through the rod.

11. The holder as recited in claim 10, wherein the pivot member further comprises a nut and wherein the rod is a screw to which the nut is attached.

12. The holder as recited in claim 10, wherein the restraint member has dimensions such that said restraint member is rotatable as well as pivotable relative to the body member.

13. The holder as recited in claim 10, wherein the restraint member is attached to the back portion of the body member by the rod.

14. The holder as recited in claim 10, wherein the restraint member has an opening defined in a front section thereof.

* * * * *